US005617901A

United States Patent [19]

Adriaen et al.

[11] Patent Number: 5,617,901

[45] Date of Patent: Apr. 8, 1997

[54] VARIABLE DRIVE SYSTEM FOR DRIVEN LOOM COMPONENTS

[75] Inventors: Marc Adriaen, Hollebeke; Geert Geerardyn, Nieuwkerke; Bernard Vancayzeele, Ieper, all of Belgium

[73] Assignee: Picanol N.V., Belgium

[21] Appl. No.: 597,531

[22] Filed: Feb. 2, 1996

[30] Foreign Application Priority Data

Feb. 7, 1995 [BE] Belgium ..... 9500093

[51] Int. Cl.[6] ..... D03D 51/08; D03C 3/28

[52] U.S. Cl. ..... 139/1 E; 139/1 R; 139/116.2; 192/9

[58] Field of Search ..... 139/1 E, 1 R; 192/9

[56] References Cited

U.S. PATENT DOCUMENTS 3,875,972 4/1975 Duprey ..... 139/1 E
4,448,220 5/1984 Zwiener et al. ..... 139/1 E
4,474,219 10/1984 Froment ..... 139/1 E
4,478,254 10/1984 Beaudoux et al. ..... 139/1 E
4,537,226 8/1985 Gotoh ..... 139/1 E
5,404,916 4/1995 Mueller et al. ..... 139/116.2

FOREIGN PATENT DOCUMENTS 0161012 11/1985 European Pat. Off. .

*Primary Examiner*—Andy Falik
*Attorney, Agent, or Firm*—Bacon & Thomas

[57] ABSTRACT

A loom drive comprising a drive motor (1) connected by a gear unit to first driven components (20) and to second driven components (23), a switching gear (15) being mounted inside the gear unit and being displaceable into different switch positions in such manner that in one switch position the main drive motor (1) drives the first and second driven components (20, 23) and that in another switch position the drive connection to the first or second driven components (20, 23) is interrupted.

20 Claims, 8 Drawing Sheets

VARIABLE DRIVE SYSTEM FOR DRIVEN LOOM COMPONENTS

1. Field of the Invention

The invention concerns a drive for a loom, comprising a main drive motor connected by a gear unit with first driven components and with second driven components.

2. Description of Related Art

In a known loom drive (European patent Publication No. 0 161 012), the gear unit contains a main shaft connected by a main clutch to the main drive motor and serving to drive the batten. The drive unit furthermore contains an ancillary shaft actuating the shed-forming means. This ancillary shaft is connected by an electromagnetic filling-finder clutch to the main shaft. Also this drive contains an electromagnetic accessory clutch able to couple the ancillary drive motor with the ancillary shaft. A brake for the main shaft is provided too. In gripper looms, the main shaft is also linked to gripper-drive components. Pairs of gears implement the connection between the main shaft and the batten drive and/or the gripper drive components and between the ancillary shaft and the shed actuator. A chain drive is provided between the ancillary drive motor and the ancillary shaft.

The ancillary clutch is open during weaving, during which the main clutch and the filling-finder clutch (coupling) are locked (engaged), as a result of which the batten and the shed-forming means are driven by the main motor. If it is desired to operate the loom slowly, the main clutch will be open (disengaged), whereas the filling-finder clutch and the ancillary clutch are locked, whereby the batten drive and that of the shed-forming means are implemented by the ancillary motor running at lower speed. Only the shed-forming components are actuated during filling-finding. In that case the main clutch and the filling-finder clutch are open, whereas the ancillary clutch is locked, and therefore the shed-forming components are driven at low speed by the ancillary motor. As a rule the main shaft is immobilized by the main brake during filling-finding.

SUMMARY OF THE INVENTION

The object of the invention is to create a loom-drive requiring a minimum of components and being as compact as possible and which, when operating at a speed other than normal, may realize slow loom operation and also filling-finding.

This problem is solved by mounting a switching gear inside the gear unit, said switching gear being shiftable into different switch positions, further in that a drive connection exists in one switch position between the main drive motor and the first and the second driven components, and in that in another switch position the drive connection between the first or second driven components is interrupted.

The gear unit of the invention operates with a lesser number of gear pairs and averts using several switchable clutches. Compactness is enhanced thereby and simultaneously the advantage is achieved that, on account of fewer gears, energy losses are lowered. The elimination of costly clutches furthermore also eliminates a limit on transmitted drive torque.

To implement the invention, a first gear assigned to the first driven components and a second gear assigned to the second driven components are further associated with the switching gear and this switching gear, when in a first switch position, engages both gears while, whereas, in a second switch position, it engages only one of these gears. If a speed-controlled main drive motor is used which can be switched to a low speed, it will be possible to operate the loom by means of this drive in the three required modes of operation, namely at normal speed during weaving, at low speed for slow operation, and only operating the shed-forming means during filling-finding, without having to switch a clutch.

In another embodiment of the invention, a first gear associated with the first driven components and a second gear associated with the second driven components are further associated with the switching gear and this switching gear when in a first switch position engages both gears whereas in a second switch position it engages only one of these gears and a gear of an ancillary drive. This design is especially appropriate for a loom equipped with a main drive motor which runs solely at normal speed and which will be shut down or separated in the other modes of operation by actuating a clutch. In a development of this design, the switching gear can be shifted also into a third switch position wherein it engages the gear associated with the first driven components, with the gear associated with the second driven components and also with the third gear which is a gear of the ancillary drive. As a result, both kinds of driven components are simultaneously powered by the ancillary drive, that is, the loom can be operated at low speed.

In a further embodiment of the invention, the switching gear is axially displaceable but mounted irrotationally on the main shaft driven by the main drive motor. This feature offers special compactness.

In another embodiment of the invention, means are provided to stop that gear which can be separated from the switching gear in a predetermined separation position. It is possible thereby to readjust or change the relative positions of the driven components that remain connected to the switching gear (for instance the shed-forming means) with respect to the positions of certain components (such as the batten) relative to the stopped gear, for example, in order to adjust the crossing times of the shed-forming means relative to the batten motion.

In a further design of the invention, the teeth area of the gear which is separable from the switching gear is fitted with a clearance running over part of the axial length. As a result, the axial displacement and thereby the required space required for separating this switching gear from said gear can be reduced.

In another embodiment of the invention, the main drive shaft comprises an axial borehole in the vicinity of the switching gear, with said borehole receiving a retaining device bearing an externally .projecting pin guided in axial slots of the main drive shaft, one return-spring biased side of the switching gear resting against said pin, and a shifting device being provided to act on the retaining device. Design simplicity is thereby achieved, which makes it possible to axially displace the switching gear into the particular switch positions.

BRIEF DESCRIPTION OF THE DRAWINGS

Further features and advantages of the invention are set forth in the description below of the illustrative embodiments shown in the drawings.

DESCRIPTION OF THE PREFERRED EMBODIMENTS

Figure 1:
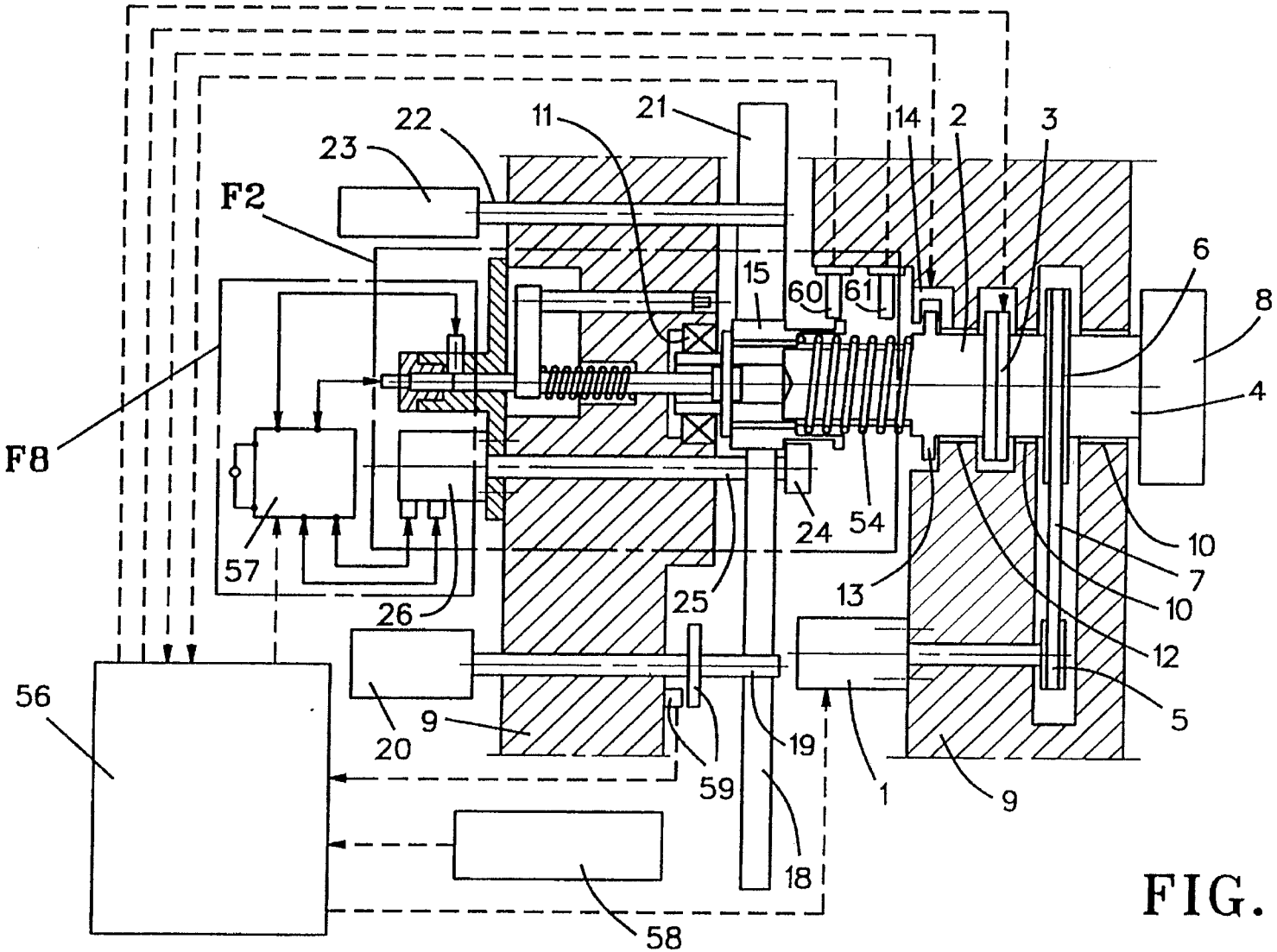
FIG. 1 schematically shows a loom drive of the invention (the gears rotating in the plane of the drawing)

The loom drive shown in FIGS. 1 through 8 comprises a main drive motor 1 powering a main shaft 2 via ancillary shaft 4. The main shaft 2 is coupled by an electromagnetic and switching clutch 3 to the ancillary shaft 4 that is connected by a belt drive to the main drive motor 1. The belt drive comprises a pulley 5 driven by the main drive motor 1 and a pulley 6 mounted on the ancillary shaft 4 and a drive belt 7. A flywheel 8 is mounted on the ancillary shaft 4. The ancillary shaft 4 rests by bearings 10 in a loom frame 9. The main shaft is supported near the clutch 3 by means of a bearing 12 and by means of a further bearing 11 in the frame 9. The main shaft 2 is fitted with a brake disk 13 associated to a brake 14 affixed to the frame 9.

During weaving, the main shaft 2 is coupled by the locked (engaged) clutch 3 to the main drive motor 1. If the loom must be stopped, the clutch 3 is disengaged and the brake 14 is actuated. The main shaft 2 is brought to a stop, while the main drive motor 1 keeps on running, driving the flywheel 8. When the loom is started again, the brake 14 is disengaged and the clutch 3 is engaged again. The energy of the flywheel 8 is used to restart the loom.

An axially displaceable switching gear 15 which can be actuated by the main drive motor 1 is affixed against relative rotation to the main shaft 2. The switching gear comprises several axial ribs 16, shown in particular in FIG. 3, which cooperate with minimal circumferential play with axial channels 17 in the main shaft 2.

The switching gear 15 engages a gear 18 connected by a shaft 19 to the first driven components 20. Essentially these first driven components may comprise the shed-forming means, which can be a dobby, a cam system, a Jacquard machine or another shed-forming means. Furthermore the first driven components may include selvage forming devices and further means such as a whip-roll drive. A further gear 21 is associated with the switching gear 15 and is connected by a shaft 22 to second driven components 23. Essentially these second driven components 23 comprise the batten and, in the event of gripper looms, gripper drives. Moreover the second driven components 23 may include selvage insertion devices, a drive for a fabric takeup-beam and a drive for the waste wind-up device.

To limit the drive torque at the main shaft 2, the diameter of the switching gear 15 is smaller than the diameters of the gears 18 and 21. The gear 21 connected by the shaft 22 to the second components 23 including the batten drive will rotate preferably once for each filling insertion. The gear 18 connected by the shaft 19 with the first driven components 20 including the shed-forming means illustratively may carry out only half a revolution for one revolution of the driven components 23 because the shed-forming means need only carry out half a stroke for one filling insertion. Accordingly the diameter of the gear 18 is twice that of the gear 21.

Figure 2:
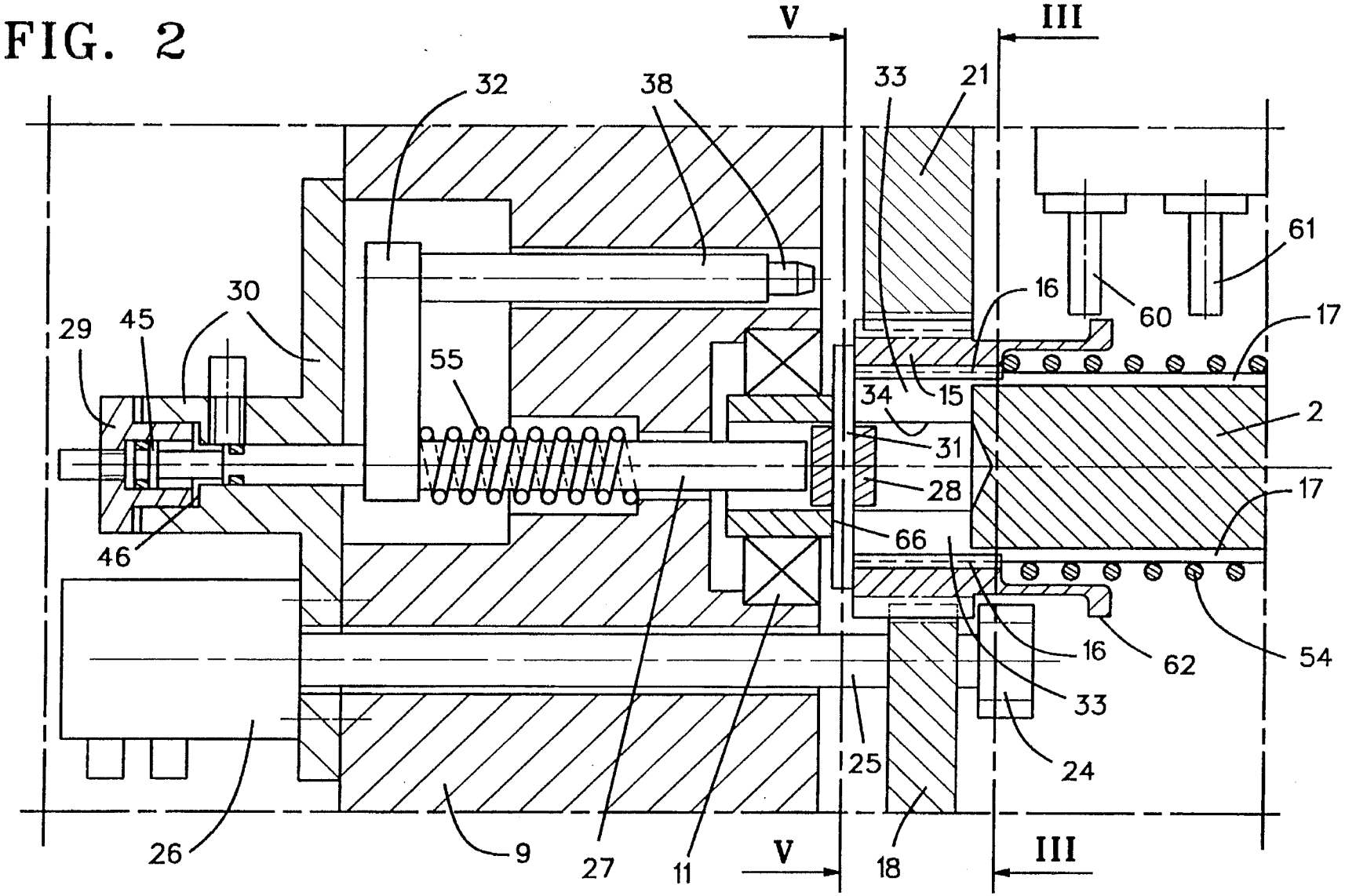
FIG. 2 shows the potion F2 of FIG. 1 on a larger scale.

In the first switch position shown in FIGS. 1 and 2, the loom is driven for weaving by the main drive motor 1. In this switch position the switching gear 15 engages both gears 18 and 21 which thus are driven by the main shaft 2. The gears 18 and 21 and the switching gear 15 are located in a common and preferably vertical plane. The main drive shaft 2 and the shafts 19 and 22 run parallel to each other.

Figure 4:
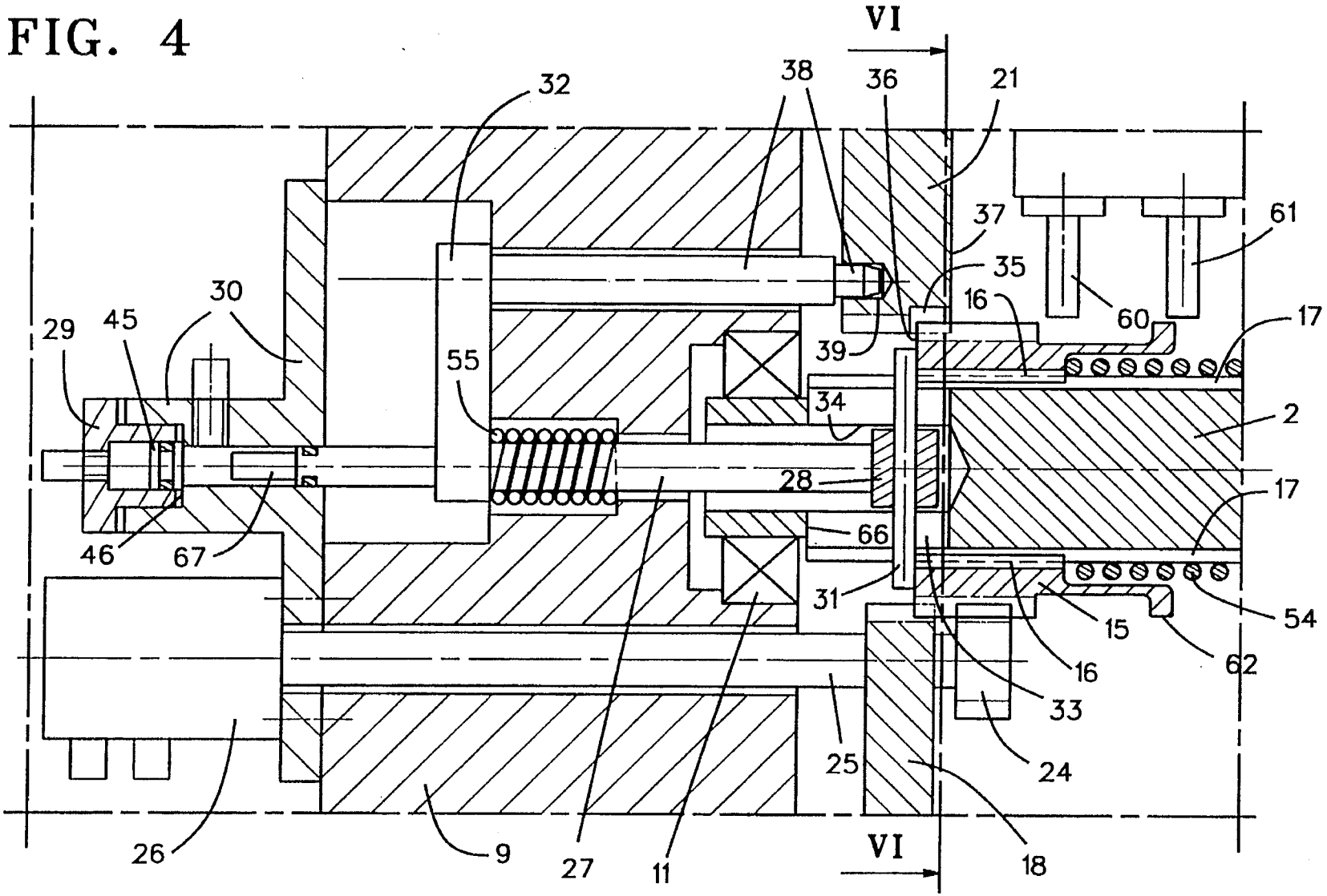
FIG. 4 is the portion F2 of FIG. 1 for another switch position.
Figure 5:
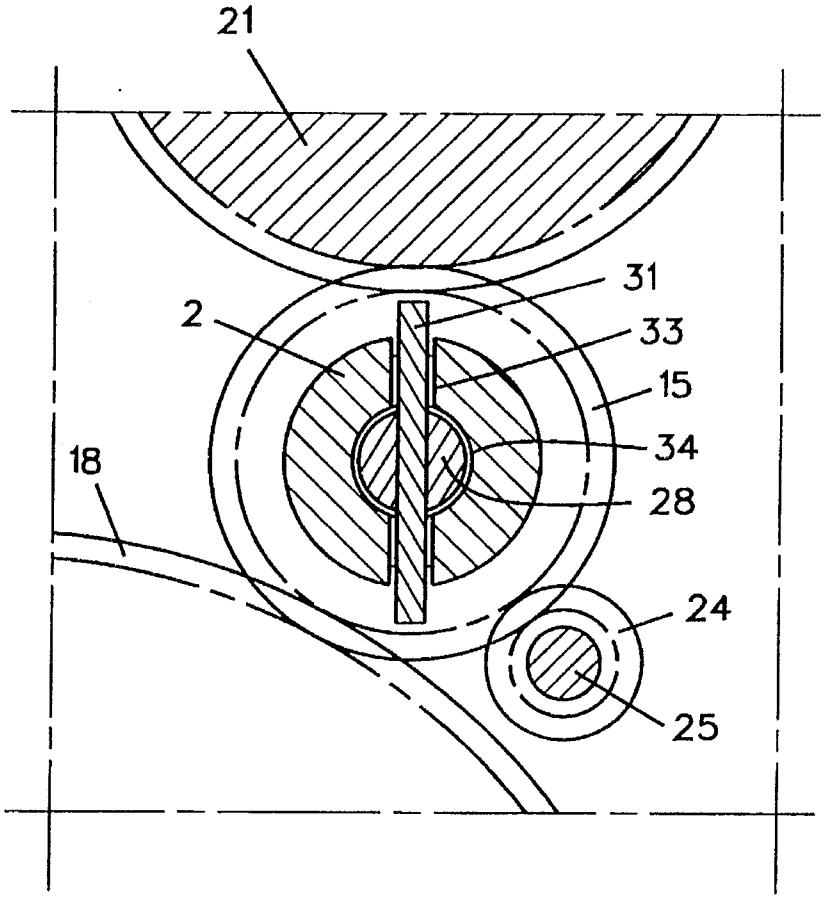
FIG. 5 is a section along line V—V of FIG. 2.

A retaining device 28 is mounted inside an axial borehole 34 of the main drive shaft 2 and receives a transverse pin 31. As shown by FIGS. 4 and 5, the pin 31 is guided in longitudinal slots 33 of the main drive shaft 2, and it extends as far as the end faces 36 of the switching gear 15. A return spring 54 presses the end face 36 of the switching gear 15 against said pin 31 which, in the first switch position of FIGS. 1 and 2, rests against the ends 66 of the longitudinal channels 33.

The retaining device 28 and thereby the pin 31 and the switching gear 15 can be set by a setting system against the opposing force of the return spring 54 into two further switch positions. The setting system comprises a mandril or rod 27 mounted in the axial extension to the main drive shaft 2 and allowing setting the retaining device 28. The end of the mandrel 27 which is away from (opposite) the retaining device 28 is designed as a piston 67 fitted with an O-ring and is mounted in a cylinder 30 affixed to the frame 9. Another cylinder 29 is mounted in the axial extension of the cylinder 30 and receives an O-ring fitted piston 45 which is coaxial with the mandril 27. The excursion of the piston 45 is limited by a stop 46.

A further return spring 55 is associated with the mandril 27 and, in the first switch position, separates the mandril 27 from the retaining device 28, whereby the mandril 27 and the retaining device 28 do not rub against each other during weaving.

Figure 6:
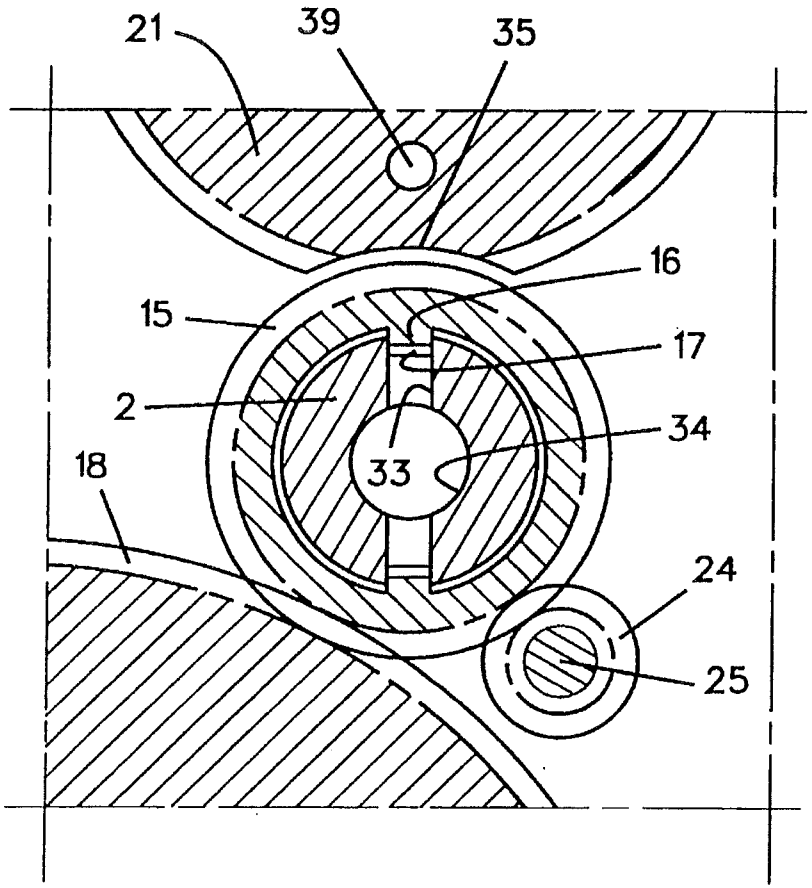
FIG. 6 is a section along line VI—VI of FIG. 4.

As shown particularly clearly in FIGS. 4 and 6, the tooth area of the gear 21 on that side toward which the switching gear 15 is displaceable comprises a clearance 35 over part of its length. The depth of this clearance 35 is such that the switching gear 15 when moved in the vicinity of this clearance 35 is disengaged from the teeth of the gear 21. The disengagement of the switching gear 15 and gear 21 has already taken place even though the end face 36 of the switching gear 15 still overlaps the adjacent end face 37 of the gear 21. Obviously the width of the gear 21 is selected in such manner that reliable transmission of the drive torque is feasible. However it is known that the drive torque for a batten will vary between a positive and a negative peak value in the course of a weaving cycle. Therefore it is possible to place a clearance 35 in that region of gear 21 where the drive torque is comparatively low. As regards airjet looms wherein the gear 21 essentially drives the batten, the drive torque to be transmitted is minimum in the vicinity of the batten beat position. As regards gripper looms, wherein the gear besides the batten also drives the gripper actuating means, the drive torque is least in two positions next to the batten beat position. This clearance makes it possible to assign a substantial width to the gear 21 without entailing thereby the need for the switching gear 15 to carry out an equally large axial displacement in order to disengage the switching gear 15 and the gear 21.

The drive further comprises means with which to stop the gear 21 when the switching gear 15 is disengaged. Said means includes a mandril or second rod 38 that is shifted jointly with the mandril 27. Said mandril 38 is affixed to a drive adapter 32 of the mandril 27 and it is guided for movement along the frame 9. Its frustoconical and affixed end may be associated with a borehole 39 in the gear 35 when the mandrel 38 is moved toward gear 21 as shown in FIG. 4. The mandril 38 is advanced in such manner relative to the gear 21 that it has already entered the aperture (or borehole) 39 before the switching gear 15 and the gear 21 are separated, that is, while the axially displaceable switching gear 15 is still moving toward the second switch position (FIG. 4). Since the mandril 38 already engages the borehole 39 before the axially displaceable switching gear 15 is separated from the gear 21, the gear 21 will always be locked reliably in place when the switching gear 15 and the gear 21 are separated. The borehole 39 is in such a position of the gear 21 that the clearance 35 in turn is in such a position when the mandril 38 and the aperture 39 are cooperating that the switching gear 15 is opposite the clearance 35 and thereby can freely rotate.

When the loom is being stopped in order to separate the second driven components 23 from the main drive and to carry out a so-called filling-finding motion, the switching gear 15 is shifted into the second switch position corresponding to FIG. 4. In the process the switching gear 15 remains coupled to the gear 18, although it is separated from the gear 21. Accordingly the gear 18 and the associated driven components can continue to be directly driven by the main drive shaft 2. In the position shown in FIG. 4, the switching gear 15 meshes both with the gear 18 and a gear 24 affixed on a shaft 25 also supported in the frame 9. Said shaft 25 is driven by a second or ancillary drive motor 26, for instance a hydraulic motor. The speed at which the ancillary motor 26 drives the main drive shaft 2 and hence the gear 18 and the associated driven components is substantially lower than the speed at which the main drive motor 1 drives the main drive shaft 2 during weaving. When the brake 14 of the main drive shaft 2 is open, a so-called filling-finding motion can be carried out in such a switched position, such that the shed-forming means are actuated.

Figure 7:
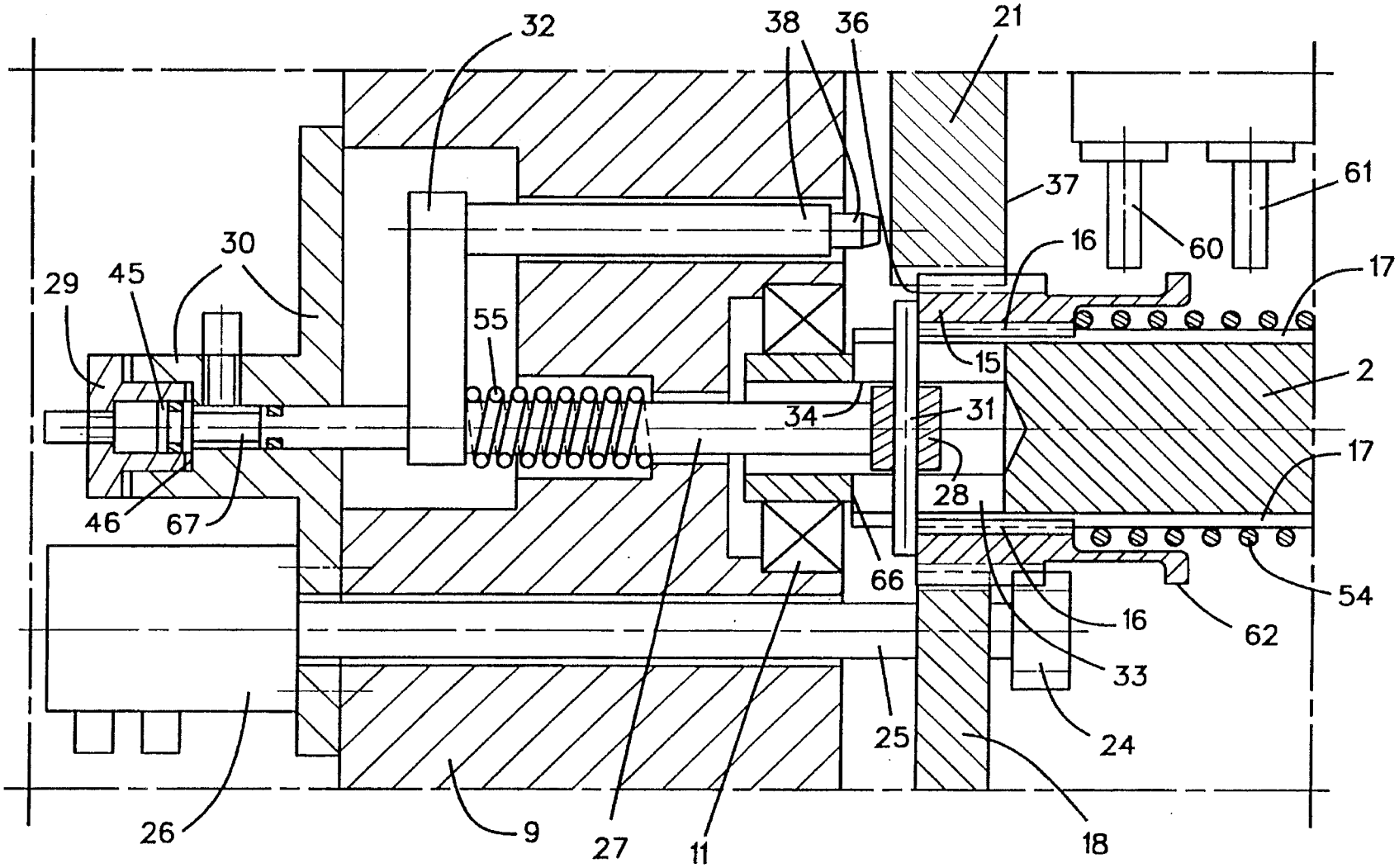
FIG. 7 shows the portion F2 of FIG. 1 for a third switch position.

As shown in FIG. 7, the switching gear 15 also may be moved into a third switch position located between the first switch position (FIGS. 1 and 2) and the second switch position (FIG. 4). In this third switch position, the switching gear 15 meshes with both gears 18 and 21 and with the gear 24 of the ancillary drive motor 26. In that switch position the ancillary drive motor 26 is able to drive both gears 18 and 20 by means of the switching gear 15, as a result of which the loom can be operated at low speed.

Figure 8:
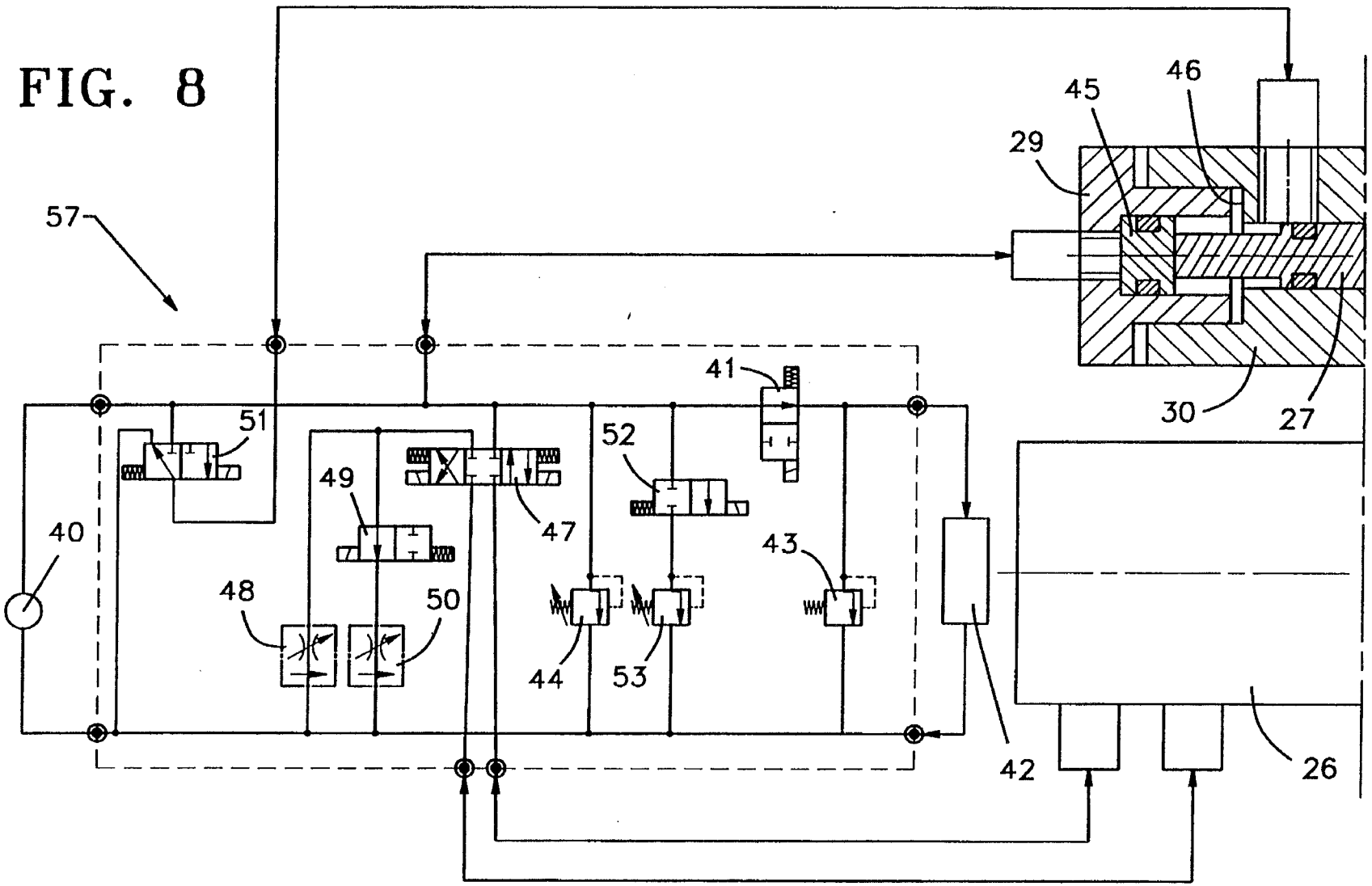
FIG. 8 shows the portion F8 of FIG. 1 in the form of a hydraulic switching diagram of the drive of the invention.

A hydraulic circuit 57 indicated in FIG. 1 and shown in more detail in FIG. 8 actuates the mandril 27. FIG. 8 shows the circuit in a state of weaving, that is, when the switching gear 15 is in the first switch position of FIGS. 1 and 2. A pump 40 feeds oil, that is lubricating oil, through a valve 41 to a lubrication system 42 of the loom. The oil pressure is regulated by an overpressure-valve 43 illustratively set at 5 bars.

When the displaceable switching gear 15 must be shifted from the first switch position of FIG. 2 into the third switch position of FIG. 7, the valve 41 is switched and closed. Thereupon the oil pressure is regulated by an overpressure-valve 44 set to a higher pressure. Illustratively the oil pressure rises from 5 bars to 80 bars. The highly pressurized oil flows toward the cylinder 29 and displaces the piston 45, against the piston end 67 of mandrel 27 until it comes to rest against the stop surface 46. The piston 45 displaces the mandril 27, the retaining device 28 with the pin 31 and the axially displaceable switching gear 15 against the force of the return springs 54 and 55. The position of the stop surface 46 is selected in such a way that the axially displaceable switching gear 15 shall be located in the third switch position corresponding to FIG. 7 wherein it meshes both with the gear 18 and with the gears 21 and 24.

The valve 47 is switched simultaneously with the valve 41 and thereby it opens a flow path in one direction or the other to the ancillary drive motor 26 in the form of a hydraulic motor. The direction of rotation of the ancillary drive motor is determined by how the valve 47 is switched. The oil flow is regulated by a flow control 48 determining the speed of the ancillary drive motor 26. This flow control 48 is set in such manner that the speed of the ancillary drive motor is very low. Thereupon the switching gear 15 can be made to mesh in simple manner with the slowly rotating gear 24. Because the gear 24 is rotating, the end faces of the teeth of the switching gear 15 are precluded from running against the end faces of the teeth of the gear 24, which would prevent meshing. To facilitate meshing, the mutually opposite teeth may be chamfered.

When the valve 49 is opened, the oil will flow through the flow control 50 which is set for a higher flow than the flow control 48. Thereupon the ancillary drive motor 26 will be operated at a higher speed appropriate to drive the loom in slow motion or otherwise to drive only the gear 18 in the filling-finder mode.

Before moving the switching gear 15 into the second switch position of FIG. 4, the ancillary motor 26 is so driven by means of the control unit 56 and the hydraulic circuit 57 that the gear 21 shall be rotated in such manner by the ancillary drive 24, 26 that the mandril 38 at least approximately shall be aligned with the aperture 39 of the gear 21. Thereupon the valve 47 will be closed. Next the valve 51 is opened, whereby oil will flow toward the cylinder 30, and as a result the piston end 67 of the mandril 27 is displaced further to the switch position shown in FIG. 4. In the process, the mandrel 38 enters the aperture 39 of the gear 21. Then the switching gear 15 will be separated from the gear 21. The drive inset or bar 32 of the mandril 27 running against the frame 9 limits the displacement of the mandril 27. Thereupon and in relation to the already aforementioned control of the valves 47 and 49, filling-finding may be carried out during which only the gear 18 is driven by the ancillary drive motor 26.

If there must be return to the switch position of FIG. 2, the gear 18 will be displaced by the below-described control of valves 47 and 49 and by means of the gear 24 driven by the ancillary drive motor 26 into a pre-separation position. Thereupon the valve 51 is switched back, whereas the valve 52 is switched ON. Presently then the oil pressure is regulated by a safety valve 53. This overpressure-valve 53 is set for a pressure between the set pressure of the overpressure-valves 43 and 44 and illustratively is 30 bars. The oil from the cylinder 30 can drain through the valve 51. The pressure of the overpressure-valve 53 is set in such manner that the force of the return springs 54 and 55 may displace the switching gear 15 and the mandril 27 against the still extant oil pressure. The switching gear 15 and the gear 21 will be meshed again with a small force. Since the teeth of the switching gear 15 are chamfered at the end face 36, the teeth of this switching gear 15 and of the gear 21 cannot be directly opposite to prevent meshing.

Thereupon the valve 41 is shut off, as a result of which it opens, and the excess pressure again is determined by the overpressure-valve 43.

The feature of shifting the switching gear 15 by using hydraulic components and/or using the hydraulic drive of the ancillary motor 26 with the lubrication-oil pump 40 offers the advantage of requiring neither additional pump nor additional oil tank. Obviously the required displacements also may be implemented using a different hydraulic circuit containing other kinds of valves, for instance controlled throttling valves, controlled throttling cocks and other hydraulic components.

The drive of the invention is controlled by a loom control-unit 56 (FIG. 1) actuating the hydraulic circuit 57, the clutch 3 and the brake 14. The control unit 56 is fed with signals from an input unit 58. These signals determine loom starts and stops, the slow motion, the slow filling-finding motion and the decoupling and recoupling of the switching gear 15 with the gear 21 of the second driven components 23 depending on the particular switch positions.

The drive comprises a position sensor 59 such as an encoder associated to the shaft 19 of the first driven components 20 and connected to the control unit 56 in order to move the shaft 19 into the desired angular position before the switching gear 15 and the gear 21 are decoupled and recoupled. That position of the gear 18 in which the mandril 38 is aligned with the gear aperture 39 is transmitted by the input unit 58 to the control unit 56. The position sensor 59 transmits the measured position of the gear 18 to the control unit 56, whereby the gear 21 can be moved by means of the control unit 56 into the appropriate position. The control unit 56 controls the ancillary drive motor 26 by correspondingly actuating the valves 47 and 49 until the measured position of the gear 18 corresponds to the position by the input unit 58. For that purpose the valve 47 is switched into the corresponding direction. The valve 49 is loaded in such manner that the ancillary drive motor 26 initially will be running rapidly until the gear 18 has approximately reached the desired position. Thereupon the valve 49 is closed while the valve 47 remains open, until the gear 18 now running at reduced speed reaches the desired position detected by the position pickup 59. This procedure might be repeated until the gear 18 precisely reaches the predetermined position. Because the gear 21 is stopped by the stop means, that is by the mandril 38, when the switching gear 15 is decoupled, then following the filling-finding motion, the gear 18 can be moved back into that position where the switching gear 15 was separated from the gear 21, whereby the switching gear 15 and the gear 21 next can be made to mesh again without changing the synchronization between the first driven components 20 and the second driven components 23.

The drive of the invention also allows shifting the crossing times of the shed-forming means in relation to the batten position. When the crossing time must be changed by a few degrees, the switching gear 15 can be separated from the gear 21, whereupon the gear 18 may be rotated by the desired number of degrees and thereupon the switching gear 15 and the gear 21 are made to mesh again. The number of angular degrees is determined using a value fed from the input unit 58 into the control unit 56 and measured by the position pickup 59. Such setting may be carried out also during filling-finding, in which case the gear 18 is not shifted into the position prior to separating switching gear 15 from gear 21, but instead is shifted into a position predetermined by the input unit 58. The number of positions in which the switching gear 15 and the gear 21 can be made to mesh equals the number of teeth on the gear 21. The angle which can be fed into the input unit 58 in order to stepwise rotate the gear 18 relative to the gear 21 equals the quotient of 180 and the number of teeth on the gear 21.

The position sensors 60, 61, illustratively proximity detectors, for the switching gear 15 are hooked-up to the control unit 56 and cooperate with a collar 62 of the switching gear 15. The position sensor 60 monitors the loom when the switching gear 15 is in the first switch position and it prevents the control unit 56 from starting the loom when the switching gear 15 is in another position. The position sensor 61 monitors whether the switching gear 15 is in the second switch position wherein it is separated from the gear 21 and it allows initiating the filling-finding motion by means of the control unit 56. Moreover the position sensors 60 and/or 61 monitor whether following filling-finding the switching gear 15 again meshes with the gear 21.

Figure 3:
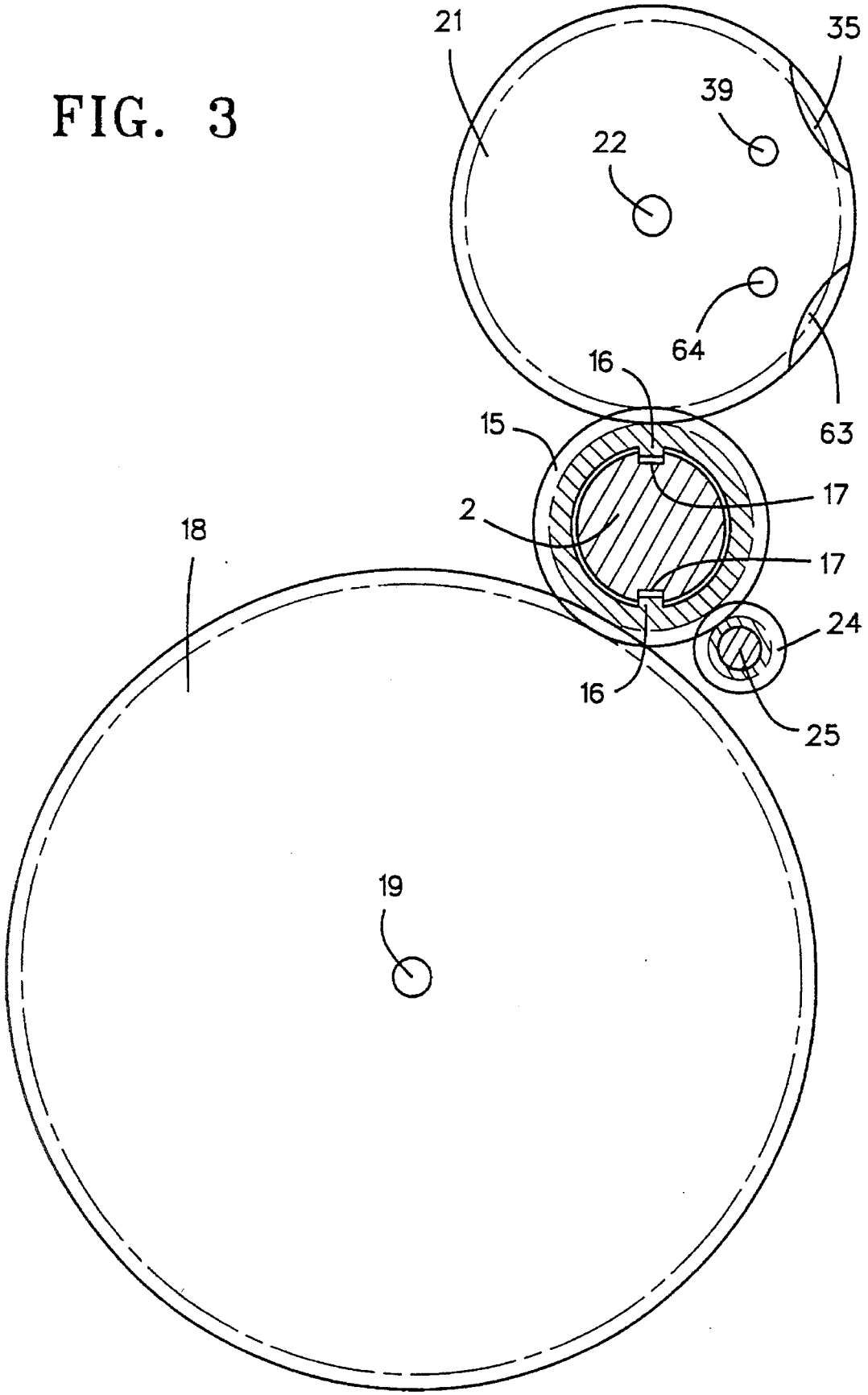
FIG. 3 is a section along line III—III of FIG. 2.

As already mentioned, the circumferential position of the clearance 35, as well as the circumferential position of the associated aperture 39, is selected in such manner that the drive torque being transmitted during weaving at this circumferential position shall be small. As regards gripper looms, wherein the gripper drive components are connected to the batten drive-components, it is known that the transmitted drive torque is low in a position a few degrees before and a few degrees after beat-up. Advantageously, as shown in FIG. 3, two clearances 35 and 63 are provided. Obviously in such a case two associated boreholes 39 and 64 are also provided in the gear 21. Two values relating to the two positions in which the switching gear 15 can be separated from the gear 21 also are fed through the input unit 58 to the control unit 56. The position in which separation shall take place is determined by the control unit 56 as a function of filling-finding being desired to take place following an insertion stoppage, a warp stoppage, a manual stoppage or a random machine stoppage.

Figure 9:
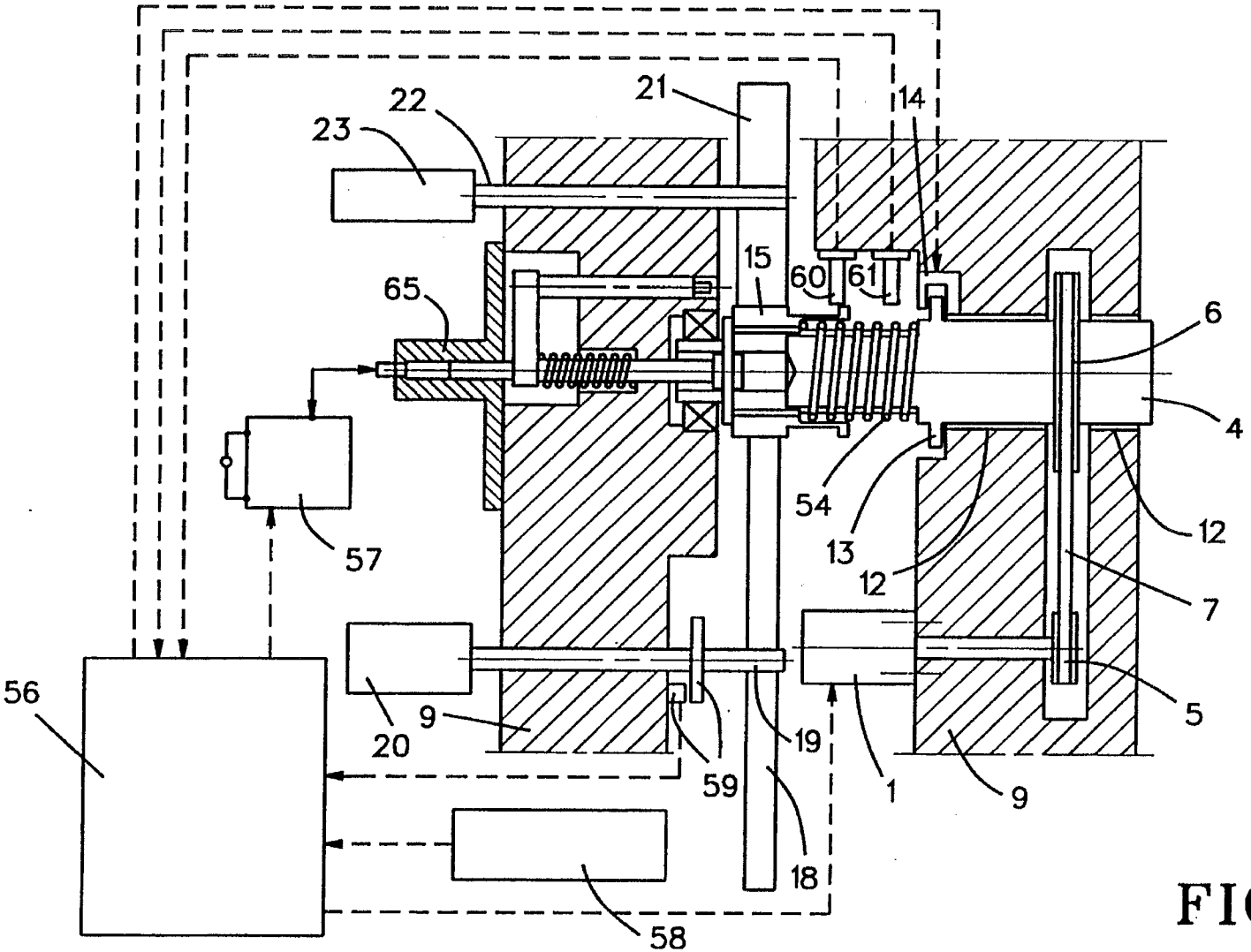
FIG. 9 shows a simplified embodiment of a loom drive of the invention with a main drive motor of at least two speeds.

FIG. 9 shows an embodiment of the invention wherein the main drive motor 1 is a motor which can run at at least at two speeds, namely a high one for weaving and a low one for filling-finding motion and slow loom operation. In this embodiment the clutch of FIG. 3 is eliminated. Also an ancillary drive has been dropped. Moreover in this embodiment the shifting device of the switching gear 15 need only shift between the first switch position wherein the switching gear 15 meshes with the gear 18 and the gear 21 on one hand and on the other the second switch position wherein the switching gear 15 is separated from the gear 21. Accordingly a single hydraulic setting device 65 suffices to allow shifting. The hydraulic circuit 57 is accordingly simplified thereby because the valves 47, 49 and 51 as well as the flow controls 48 and 50 may be eliminated.

As regards an airjet loom operated by compressed air, the above embodiments are modified in that the ancillary drive and/or the shifting device for the switching gear 15 are actuated pneumatically. In a further variation, a modified shifting device is used to axially and step-wise shift the switching gear 15.

The disclosed embodiments are exemplary only, and it is to be understood that the invention is not to be limited beyond what is set forth in the following claims.

We claim:

1. In a loom drive system including a main drive motor, a gear unit drivingly connected to the main drive motor and at least two groups of driven loom components normally driven by the main motor through the gear unit, the improvement comprising:

a switching gear in the gear unit mounted so as to be movable between at least two positions whereat, in a first position, the first and second groups of driven loom components are drivingly connected to the main drive motor via the switching gear and in a second position one of the groups of driven loom components is disengaged from the switching gear and the main drive motor.

2. In a loom drive system as claimed in claim 1, the further improvement comprising:

first and second driven gears arranged respectively to drive said first and second groups of driven components;

said switching gear and driven gears including sets of switching gear and driven gear teeth, respectively, said switching gear teeth being drivingly connected to both sets of driven gear teeth in said first position, and to the set of teeth of one driven gear in said second position.

3. In a loom drive system as claimed in claim 2, the further improvement comprising:

an ancillary drive motor;

means for drivingly connecting said ancillary drive motor to said switching gear when said switching gear is in said second position.

4. In a loom drive system as claimed in claim 2, the further improvement comprising:

means for preventing rotation of the one of said driven gears that is not drivingly connected to said switching gear when said switching gear is in said second position.

5. In a loom drive system as claimed in claim 2, the further improvement comprising:

the set of teeth of the one of the driven gears that is not drivingly connected to said switching gear when said switching gear is in said second position extend axially and are spaced circumferentially about the periphery of the respective one driven gear;

said gear teeth of said one of the driven gears being axially shortened over a circumferential area about the periphery of the one driven gear, said circumferential area corresponding to a location adjacent said switching gear at its second position;

said axially shortened teeth providing a clearance between the teeth of said driven gear and the adjacent teeth of the switching gear when the switching gear is at said second position and said shortened teeth are located adjacent said switching gear.

6. In a loom drive system as claimed in claim 5, the further improvement wherein said one driven gear is arranged in the loom drive system such that the torque transmitted between the switching gear and the one gear varies between minimum and maximum values, and said shortened teeth are located on the periphery of said one driven gear at a location corresponding to that location whereat the switching gear transmits minimum torque to the one driven gear from the main drive motor.

7. A loom drive system as claimed in claim 2, the further improvement comprising:

a driven gear position detector arranged to detect the rotational position of the driven gear that includes teeth that remain drivingly connected to said switching gear when the switching gear is moved to said second position.

8. In a loom drive system as claimed in claim 3, the further improvement comprising:

said switching gear being mounted so as to be moveable to a third position whereat said switching gear is drivingly connected to said first and second driven gears and to said ancillary motor.

9. In a loom drive system as claimed in claim 3, the further improvement comprising:

an ancillary motor gear drivingly connected to said ancillary motor;

said switching gear arranged to be drivingly connected to said ancillary motor gear when in said second position.

10. In a loom drive system as claimed in claim 3, wherein the loom drive system is adapted to be located in a loom having a pressurized hydraulic fluid lubricating system, the further improvement comprising:

said ancillary drive motor comprising a hydraulic motor;

said hydraulic motor arranged to receive pressurized hydraulic lubricating fluid from said lubricating system; and means for controlling the flow of pressurized hydraulic lubricating fluid to said hydraulic motor.

11. In a loom drive system as claimed in claim 8, the further improvement comprising:

an ancillary motor gear drivingly connected to said ancillary motor;

said switching gear arranged to be drivingly connected to said ancillary motor gear when in said third position.

12. In a loom drive system as claimed in claim 1, wherein said gear unit includes a main drive shaft drivingly connected to said main motor, the further improvement comprising:

said switching gear mounted for axial sliding movement on said main drive shaft, said axial movement enabling said switching gear to reach said at least two positions.

13. In a loom drive system as claimed in claim 12, the further improvement comprising:

a switching clutch associated with the main drive shaft for selectively coupling and uncoupling the main drive motor to and from the main drive shaft.

14. In a loom drive system as claimed in claim 12, the further improvement comprising:

a switching brake for selectively stopping and preventing rotation of the main drive shaft.

15. In a loom drive system as claimed in claim 1, the further improvement comprising:

said main motor including a speed control device associated therewith.

16. In a loom drive system as claimed in claim 1, the further improvement comprising:

a main drive shaft drivingly connected to said main drive motor;

said switching gear mounted for axial sliding movement on said main drive shaft, said movement permitting said movement of said switching gear between said at least two positions;

said main drive shaft having a central axial borehole therein adjacent the position of the switching gear on the main drive shaft;

a switching gear retainer extending transversely through the main drive shaft and said borehole so as to partially extend radially outwardly of the main drive shaft borehole adjacent one side of the switching gear;

said main drive shaft including axially elongated radially extending apertures intersecting said borehole on diametrically opposite sides of said main drive shaft;

said retainer extending through said elongated apertures;

a retainer spring on the main drive shaft arranged to bias said one side of the switching gear against said retainer;

a shifting means for moving and controlling the position of said switching gear, said switching means including means for engaging said retainer and for moving the switching gear axially along the main drive shaft via said retainer against the bias of said retainer spring and for controlling the position of said switching gear in response to the bias of said retainer spring.

17. In a loom drive system as claimed in claim 16, the further improvement comprising:

said shifting means including means for moving the shifting means into at least two pre-determined positions.

18. In a loom drive system as claimed in claim 16, the further improvement comprising:

a driven gear rotation preventing means for preventing rotation of the one of the driven gears that is not drivingly connected to said switching gear when said switching gear is in said second position;

said shifting means including means for actuating said driven gear rotation preventing means to lock said one driven gear against rotation when said switching gear is moved to said second position.

19. In a loom drive system as claimed in claim 16, wherein the loom drive system is adapted to be located in a loom having a pressurized hydraulic fluid lubricating system, the further improvement comprising:

said shifting means is arranged to be hydraulically actuated by the pressurized hydraulic fluid of the loom lubricating system; and means for controlling the flow of pressurized hydraulic lubricating fluid to the shifting means.

20. A loom drive system as claimed in claim 1, the further improvement comprising:

a switching gear position detector arranged to detect the location of the switching gear at least at said at least two positions.

* * * * *